US008175284B2

(12) United States Patent
Goldberg et al.

(10) Patent No.: US 8,175,284 B2
(45) Date of Patent: May 8, 2012

(54) METHOD AND APPARATUS FOR CALIBRATING SOUND-REPRODUCING EQUIPMENT

(75) Inventors: Andrew Goldberg, Espoo (FI); Aki Makivirta, Lapinlahti (FI); Jussi Tikkanen, Iisalmi (FI); Juha Urhonen, Iisalmi (FI)

(73) Assignee: Genele Oy, Iisalmi (FI)

( * ) Notice: Subject to any disclaimer, the term of this patent is extended or adjusted under 35 U.S.C. 154(b) by 763 days.

(21) Appl. No.: 12/294,909

(22) PCT Filed: Mar. 23, 2007

(86) PCT No.: PCT/FI2007/050158

§ 371 (c)(1),
(2), (4) Date: Feb. 6, 2009

(87) PCT Pub. No.: WO2007/110478

PCT Pub. Date: Oct. 4, 2007

(65) Prior Publication Data

US 2009/0180632 A1 Jul. 16, 2009

(30) Foreign Application Priority Data

Mar. 28, 2006 (FI) ..... 20060295

(51) Int. Cl.
*H04R 29/00* (2006.01)

(52) U.S. Cl. ..... 381/59; 381/103; 381/303

(58) Field of Classification Search ..... 381/58, 381/59, 103, 303

See application file for complete search history.

(56) References Cited

U.S. PATENT DOCUMENTS

| | | | | |
|---|---|---|---|---|
| 5,666,424 | A | 9/1997 | Fosgate et al. | |
| 6,111,755 | A | 8/2000 | Park | |
| 6,798,889 | B1 | 9/2004 | Dicker et al. | |
| 2003/0099365 | A1 * | 5/2003 | Karjalainen et al. | 381/61 |
| 2005/0031135 | A1 | 2/2005 | Devantier et al. | |
| 2005/0069153 | A1 | 3/2005 | Hall et al. | |
| 2005/0254662 | A1 | 11/2005 | Blank et al. | |
| 2010/0202624 | A1 * | 8/2010 | Makinen et al. | 381/59 |
| 2010/0303250 | A1 * | 12/2010 | Goldberg et al. | 381/59 |

FOREIGN PATENT DOCUMENTS

| | | | |
|---|---|---|---|
| EP | 0989776 | A2 | 3/2000 |
| EP | 1017167 | A2 | 7/2000 |
| EP | 1349427 | A2 | 10/2003 |
| WO | WO-2007/028094 | A1 | 3/2007 |

* cited by examiner

*Primary Examiner* — A O Williams

(74) *Attorney, Agent, or Firm* — Muncy, Geissler, Olds & Lowe, PLLC

(57) ABSTRACT

A method and apparatus in a sound-reproduction system, in which method an electrical calibration signal is formed, an audio signal is formed in the loudspeaker from the calibration signal, the response of the audio signal is measured and analysed, and the loudspeaker system is adjusted on the basis of the measurement results. The operator is permitted to made additional alterations to the settings of the loudspeaker system on the basis of the measurement performed, the effects of the alterations are calculated and displayed to the operator without additional measurements, and the additional settings are implemented in real time in the loudspeaker system.

15 Claims, 2 Drawing Sheets

METHOD AND APPARATUS FOR CALIBRATING SOUND-REPRODUCING EQUIPMENT

BACKGROUND OF THE INVENTION

1. Field of the Invention

The present invention relates to a method in a sound-reproduction system, in which an electrical calibration signal is formed, an audio signal is formed in the loudspeaker from the calibration signal, the response of the audio signal is measured and analysed, and the loudspeaker system is adjusted on the basis of the measurement results.

The invention also relates to an apparatus in a sound-reproduction system, which comprises a loudspeaker, control apparatus for the loudspeaker, signal and control connections to the loudspeaker, a microphone for measuring the response of the loudspeaker, and analysis and control apparatuses for analysing and setting the signal obtained from the microphone, on the basis of the analysis results.

2. Brief Discussion of the Related Art

According to the prior art, calibration methods are known, in which a test signal is fed to a loudspeaker. The response to the test signal is measured using a measuring system and the frequency response of the system is adjusted to be as even as possible using an equalizer.

A drawback of the state of the art is that in, for example, interference situations, the measuring arrangement must always be renewed and this is a time-consuming operation that thus increases costs.

The invention is intended to eliminate the defects of the state of the art disclosed above and for this purpose create an entirely new type of method and apparatus for calibrating sound-reproduction equipment.

SUMMARY OF THE INVENTION

The invention is based on recording the measurement result of the sound-reproduction equipment as such in the system and at the same time also recording the parameters of the equalization filter formed. The operator is permitted to make further settings for the filter with the aid of the recorded measurement results. The results of the alteration to the filtering are displayed to the operator in real time and the alteration data are applied in the loudspeaker.

According to a second preferred embodiment of the invention, the active loudspeaker is equipped with a signal generator, which can be used to form a logarithmically scanning sinusoidal test signal.

According to a third preferred embodiment of the invention, the level of the measuring signal is adjusted in such a way as to achieve the greatest possible signal-noise ratio.

According to a fourth preferred embodiment of the invention, the phase of the main loudspeaker and the subwoofer is set to be the same at the crossover frequency, with the aid of a sine generator built into the active subwoofer loudspeaker.

According to a fifth preferred embodiment of the invention, a logarithmic sine signal is used to equalize the frequency responses of the loudspeakers at the listening positioning (the location of the microphone), in order to eliminate differences in the mutual levels and time-of-flight delays of the loudspeakers in the loudspeaker system.

More specifically, the method according to the invention is characterized in that the operator is permitted to make additional alterations to the settings of the loudspeaker system on the basis of the measurement performed, the effects of the settings are calculated and displayed to the operator without additional measurements, and the additional settings are implemented in real time in the loudspeaker system.

The apparatus according to the invention is, in turn, characterized in that the apparatus comprises means, with the aid of which the operator is permitted to make additional alterations to the settings of the loudspeaker system, on the basis of the measurement performed, means for calculating the effects of the settings and presenting them to the operator without additional measurements, and means for implementing the additional settings in real time in the loudspeaker system. Considerable advantages are gained with the aid of the invention.

With the aid of the method according to the invention, the operator is able to alter the settings of the loudspeaker in real time and see the effects of the settings without additional measurements. The operator gains a considerable saving in time, as a risk of interference is associated with each acoustic measurement. If the risk is realized, the measurement must be repeated.

According to the second preferred embodiment of the invention, because the test signal is not fed from the computer to the loudspeaker, but arises in the loudspeaker, there are no other distortions or changes created in the test signal besides the acoustic response.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
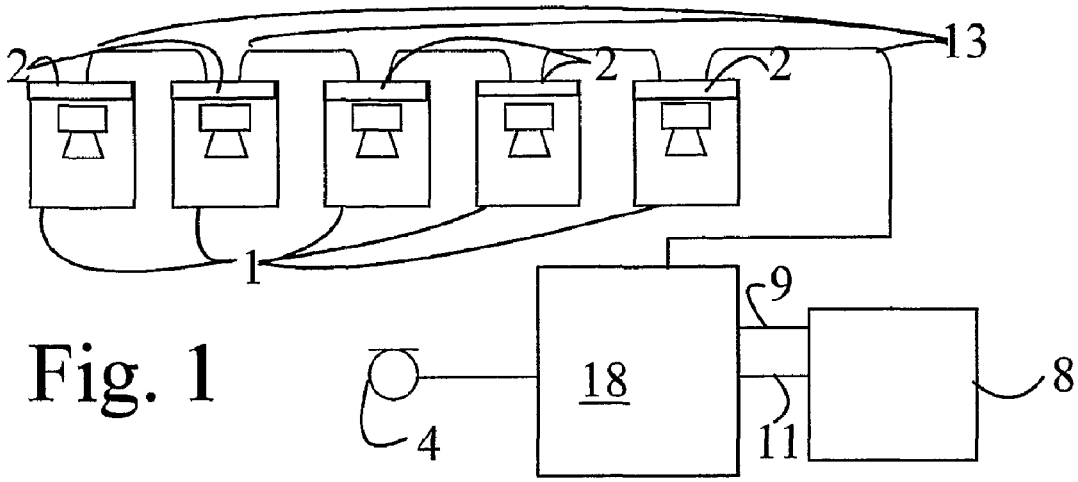
FIG. 1 shows a block diagram of one system suitable for the method according to the invention.

In the invention, the following terminology is used:

1 loudspeaker
2 loudspeaker control unit
3 acoustic signal
4 microphone
5 preamplifier
6 analog summer
7 sound card
8 computer
9 measuring signal
10 test signal
11 USB link
12 control-network controller
13 control network

14 IO line
15 signal generator
16 loudspeaker element
18 interface device
50 calibration signal

DETAILED DESCRIPTION OF THE PREFERRED EMBODIMENTS

FIG. 1 shows an apparatus totality, in which loudspeakers 1 are connected to a computer 8 through a control network 13, by means of an interface device 18.

Figure 2:
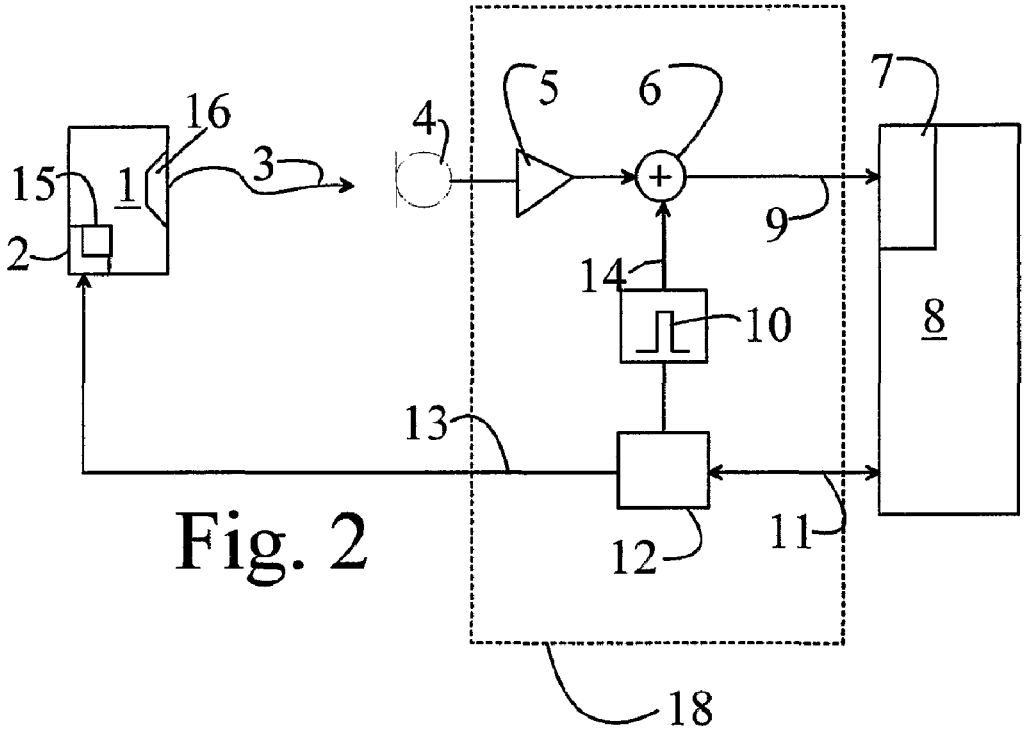
FIG. 2 shows a second calibration circuit according to the invention.

The interface device 18 contains a control-network controller 12 according to FIG. 2, a preamplifier 5 and an analog summer 6, to which an IO line 15 coming from the control-network controller, through which IO line a test signal 10 is transmitted to the summer, is connected.

FIG. 2 contains the same functions as FIG. 1, but only one loudspeaker 1 is shown, for reasons of clarity.

Figure 5:
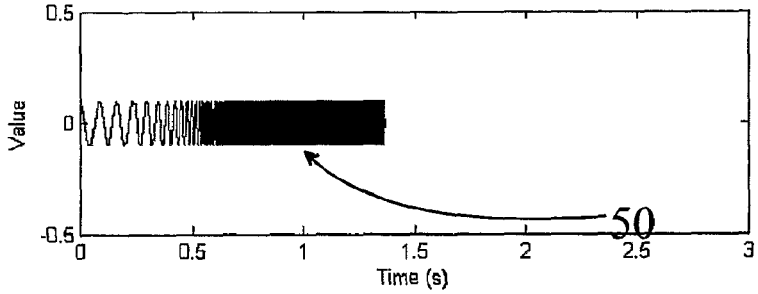
FIG. 5 shows graphically the test signal generated by the loudspeaker.

FIG. 2 shows the apparatus totality of the invention, in which the loudspeaker 1 produces an acoustic signal 3. For test purposes an acoustic signal 3 is created from an electrical calibration signal formed by the generator 15 of the control unit 2 of the loudspeaker itself. The control unit 2 typically contains an amplifier thus making the loudspeaker (1) an active loudspeaker. The test signal is preferably a sinusoidal scanning signal, such as is shown graphically, among others, in FIG. 6. The frequency of the calibration signal 50 (FIG. 5) is scanned over the range of human hearing, preferably in such a way that this starts from the lowest frequencies and the frequency is increased at a logarithmic speed towards the higher frequencies. The generating 50 of the calibration signal is started by a signal brought to the control unit 2 of the loudspeaker 1 over the control bus 13. The acoustic signal 3 is received by the microphone 4 and amplified by a preamplifier 5. In the analog summer 6, the signal coming from the preamplifier 5 is combined with the test signal 10, which is typically a square wave. The analog summer 6 is typically a circuit implemented using an operation amplifier. The test signal 10 is obtained from the control unit 12 of the control network. In practice, the test signal can be obtained directly from the IO line 14 of the microprocessor of the control unit of the control network.

Thus, according to the invention the acoustic measuring signal 3 can be initiated by remote control through the control bus 13. The microphone 4 receives the acoustic signal 3, with which the test signal 10 is summed. The sound card 7 of the computer 8 receives a sound signal, in which there is initially the test signal and then after a specific time (the acoustic time-of-flight) the response 9 of the acoustic signal, according to FIG. 2.

Figure 3:
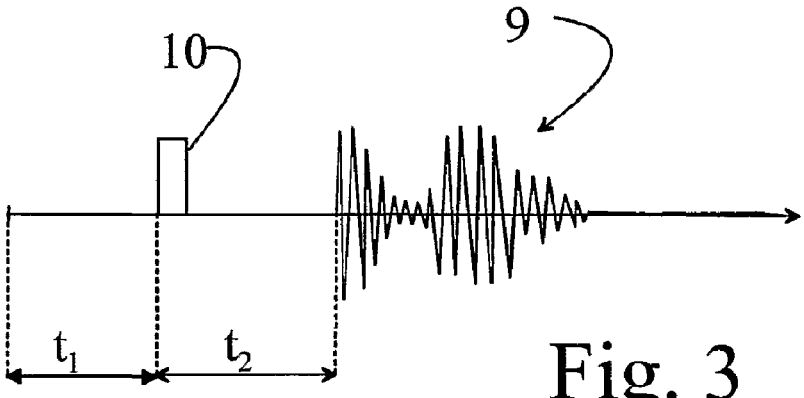
FIG. 3 shows graphically the signal according to the invention, which the computer sound card records.
Figure 4:
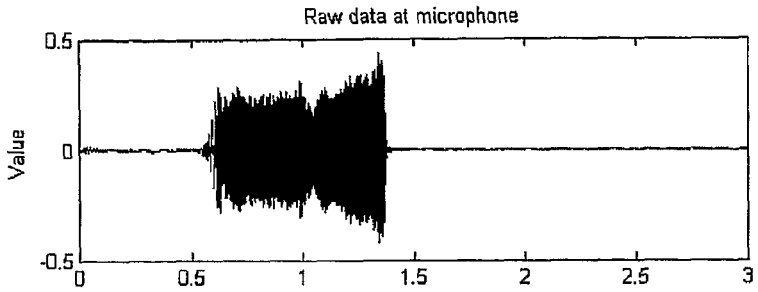
FIG. 4 shows graphically a typical measured signal in the calibration arrangement according to the invention.

FIG. 3 shows the signal produced in the computer's sound card 7 by the method described above. The time $t_1$ is a randomly varying time caused by the operating system of the computer. The time $t_2$ to the start of the acoustic response 9 is mainly determined on the basis of the acoustic delay (time of travel), and random variation does not appear in it. The acoustic response 9 is the response of the loudspeaker-room system to the logarithmic sinusoidal scanning, the frequency of which is increasing.

In the first preferred embodiment of the invention, in which the frequency response of an unknown sound card is calibrated, the procedure is as follows. The pulse shape is generated by the controller 12 of the control network, which is connected to the computer's 8 sound card 7 and preferably to the computer's USB bus 11. Under the control of a program run by the computer, the control-network controller produces the test signal 10. The sound card 7 is used to record the received pulse shape, which arises as the response of the input of the computer 8 sound card 7 to the test signal.

A pulse wave 10 (in which there are two values: zero and a voltage corresponding to one) produced by the digital IO line 14 can be used as the input pulse.

The input pulse 10 can be summed (analogically) with the microphone signal.

The test signal 10 recorded in the sound card changes its shape due to the filtering caused by the sound card. It is known that the frequency response of the sound card is a bandpass frequency response, which includes a high-pass property (at low frequencies) and a low-pass property (at high frequencies). The original shape 10 of the test signal is known to the computer. A model, in which the original test signal travels through a filter depicting the filtering properties of the sound card, is applied to the recorded test signal 10. In a preferred implementation, the parameters of the transfer function of the filter are selected with the aid of optimization using an adaptation method, in such a way that the filtered test signal 10 produced by this model corresponds in shape as accurately as possible to the real test signal recorded by the sound card. The frequency response H (b,a), in which b and a are the parameters of the frequency-response model, caused by filtering, will then have been defined.

Using the frequency response thus defined, an equalizer is formed, by means of which the frequency response H can be equalized with the frequencies corresponding to the range of human hearing. The equalization thus defined is used later, when the acoustic responses are measured. When the measured acoustic response is corrected using this equalization, the filtering caused by the sound card is corrected at the frequencies in the range of human hearing.

The selection of the structure and degree of the transfer function being modelled can be used to affect the accuracy and the speed of the measurement.

According to the second preferred embodiment of the invention, the voltage of the test signal 15 produced by the IO line 14 is set to a specific value.

In this method, the generation of the known test signal 10 is combined to be part of the command that initiates the calibration signal 50 (log-sine scanning) produced by the loudspeaker.

The computer 8 records the signal, which consists of three parts. First is the test signal 10, after it silence, the third to arrive at the microphone being the acoustic signal 3 produced by the loudspeaker, which is recorded as the response 9. The following can be read from the recorded information:

With the aid of the voltage of the test signal, the magnitude of the digital word recorded in the computer can be measured in volts. (Because the height of the pulse in volts can be known beforehand and the magnitude of the digital representation of the pulse can be examined from the stored signal.)

The time $t_2$ between the start of the test signal 10 and the start of the acoustic response 9 depicts the distance of the loudspeaker 1 from the measuring microphone 4, and by using this information it is possible to calculate the distance of the loudspeakers 1 (reproducing the entire audio band) from the measuring point. Most advantageously this takes place by taking as the initial data for the FFT calculation a signal, which includes the signal recorded by the sound card 7 beginning from the start of the test signal 10 (the start of the time $t_2$ in FIG. 3) and setting the test signal 10 in it to zero before beginning the calculation.

The command to generate the test signal comes from the computer 8. In practice however, it will be observed that the delay (FIG. 3, $t_1$) after which the command leaves, varies independently of the operating system (Windows, Mac OS X). This delay is random and cannot be predicted. Once the command has left, and because the command and test signal are linked to one and the same function, there is always a known and constant time from the generation of the test signal to the start of the generating of the measuring signal (i.e. the calibration signal). In addition to this, there is a time, which is affected only by the distance between the loudspeaker and the measuring microphone, to the start of the acoustically recorded measuring signal.

According to the third preferred embodiment of the invention, a generator 15, which produces a calibration signal 50 that is precisely known beforehand, is built into the loudspeaker 1.

The calibration signal produced by the generator 15 is sine-scanning, the speed of which frequency scanning increases in such a way that the logarithm of the frequency at the moment is proportional to the time, log(f)=k t, in which f is the momentary frequency of the signal, k is a constant defining speed, and t is time. The increase in frequency accelerates as time passes.

Because the test signal is precisely defined mathematically, it can be reproduced in the computer accurately, irrespective of the test signal produced by the loudspeaker 1.

Such a measuring signal contains all the frequencies while the crest factor (the relation of the peak level to the RMS level) of the signal is very advantageous in that the peak level is very close to the RMS level, and thus the signal produces a very good signal-noise ratio in the measurement.

As the signal 50 (FIG. 5) starts moving from the low frequencies and its frequency increases, the signal operates advantageously in rooms with a reverberation time that is usually longer at low frequencies than at high frequencies.

The generation of the calibration signal 50 can be initiated using a command given through remote control.

According to the fourth preferred embodiment of the invention, the magnitude of the calibration signal 50 produced in the loudspeaker can be altered through the control network 13.

The calibration signal 50 is recorded. The magnitude of the acoustic response 9 of the calibration signal 50 relative to the calibration signal is measured. If the acoustic response 9 is too small, the level of its calibration signal 50 is increased. If the acoustic response 9 is peak limited, the level of the calibration signal 50 is reduced.

The measurement is repeated, until the optimal signal-noise ratio and level of the acoustic signal 9 have been found.

Level setting can be performed for each loudspeaker separately.

Because the extent to which the level has been altered is controlled by the computer 8 and thus known, this information can be taken into account when calculating the results, so that a reliable measurement result, which is scaled correctly relative to the level, will be obtained irrespective of the distance.

According to the fifth preferred embodiment of the invention, an internal sine generator is used in the subwoofer. The phase of the subwoofer is adjusted from the computer through the control network 13 and the acoustic signal is measured using the microphone.

Setting the subwoofer and the main loudspeaker to the same phase at the crossover frequency takes place in two stages.

Stage 1: the levels of the subwoofer and the reference loudspeaker are set to be the same by measuring one or both levels separately and setting the level produced by each loudspeaker.

Stage 2: both loudspeakers repeat the same sine signal, which the subwoofer generates.

The common sound level is measured by the microphone.

The phase is adjusted and the phase setting at which the sound level is at a minimum is sought. The loudspeaker and subwoofer are then in an opposing phase.

The subwoofer is altered to a phase setting that is at 180 degrees to this, so that the loudspeaker and the subwoofer are in the same phase and thus the correct phase setting has been found.

According to the sixth preferred embodiment of the invention, the acoustic impulse response of all the loudspeakers 1 of the system is measured using the method described above. Such a calibration arrangement is shown in FIG. 3.

The frequency response is calculated from each impulse response.

The distance of the loudspeaker is calculated from each impulse response.

On the basis of the frequency response, settings of the equalizer filter that will achieve the desired frequency response in the room (even frequency response) are planned.

The (relative) sound level produced by the equalized response is calculated.

A delay is set for each loudspeaker, by means of which the measured response of all the loudspeakers contains the same amount of delay (the loudspeakers will appear to be equally distant).

A level is set for each loudspeaker, at which the loudspeakers appear to produce the same sound level at the measuring point. The level of each loudspeaker can be measured from the frequency response, either at a point frequency, or in a wider frequency range and the mean level in the wider frequency range can be calculated using the mean value, RMS value, or median. In addition, different weighting factors can be given to the sound level at different frequencies, before the calculation of the mean level. The frequency range and the weighting factors can be selected in such a way that the sound level calculated in this way from the different loudspeakers and subwoofers is subjectively as similar as possible. In a preferred implementation, the mean level is calculated from the frequency band 500 Hz-10 kHz, using the RMS value and in such a way that all the frequencies have the same weighting factor.

The subwoofer(s) phase is then adjusted as described above.

Figure 6:
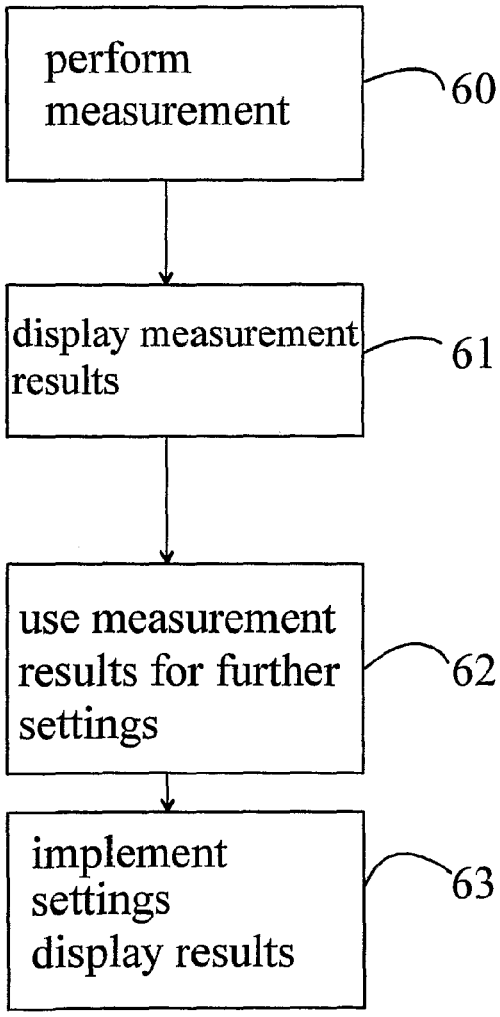
FIG. 6 shows as a flow diagram the method according to the invention.

According to FIG. 6, in stage 60 of the invention the response of the loudspeaker 1 is measured, in stage 61 the operator is shown the measurement results without equalization, and in stage 62 the operator is permitted to make corrections to the equalization, on the basis of the first measurement 60. The effects of the alterations to the response are calculated and displayed to the operator and implemented through 63 the settings of the loudspeaker.

In practice, in the method according to the invention the operator is thus permitted to create a new filter with the aid of the control system and at the same time the effects of the filter on the acoustic measurement are displayed to the operator in real time, without a need for a new measurement. With the aid of the control system, the alterations to the filter are transmitted in real time to the loudspeaker, so that the operator can simultaneously hear the results of the alteration to the filter, in addition to being able to see the results of the alteration in real time as a graphical presentation on the display of the computer.

In the present application the term audio frequency range refers to the frequency range 10 Hz-20 kHz.

In a preferred implementation, the stages described above are performed in the following order:

- the acoustic responses of all the loudspeakers are recorded with the aid of the computer sound card,
- the impulse response of the loudspeaker is calculated from each of the responses,
- the time of travel of the sound is measured from each impulse response and the distance of the loudspeaker is calculated on its basis,
- on the basis of the distance of each loudspeaker, the additional delay that makes the time of travel of the sound coming from the loudspeaker the same as that of the time of travel of the other loudspeakers is calculated,
- the frequency response is calculated from each impulse response,
- on the basis of the frequency responses, the levels of the loudspeakers are calculated,
- a correction is calculated for each loudspeaker, which will make its level the same as that of the other loudspeakers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method in a sound-reproduction system, in which an electrical calibration signal is formed, an audio signal is formed in a loudspeaker from the calibration signal, a response of the audio signal is measured and analysed, and a loudspeaker system is adjusted on the basis of a measurement results, wherein:

- an operator is permitted to make additional alterations to settings of the loudspeaker system on the basis of the measurement performed,
- the effects of the settings are calculated and displayed to the operator without additional measurements, and
- the additional alterations to the settings are implemented in real time in the loudspeaker system.

2. The method according to claim 1, wherein scanning speed of the calibration signal is logarithmic.

3. The method according to claim 1, wherein a scanning of the calibration signal is started from a low frequency range of human hearing.

4. The method according to claim 1, wherein data is displayed on a display of the computer.

5. The method according to claim 1, wherein the method is used for determining a distance from the loudspeaker and a measuring microphone.

6. The method according to claim 1, wherein the method is used to set the phase of a subwoofer and a loudspeaker to be the same at a crossover frequency.

7. The method according to claim 1, wherein the method is used for calibrating the response of all the loudspeakers of the system in a listening room.

8. An apparatus in a sound-reproduction system, which comprises a loudspeaker, control apparatus for the loudspeaker, signal and control connections to the loudspeaker, a microphone for measuring a response of the loudspeaker, and analysis and control apparatuses for analysing and setting a signal obtained from the microphone, based on the analysis results, wherein the apparatus comprises means, with the aid of which:

- an operator is permitted to make additional alterations to the settings of the loudspeaker system, on the basis of the measurement performed,
- means for calculating the effects of the settings and presenting them to the operator without additional measurements, and
- means for implementing the additional alterations to the settings in real time in the loudspeaker system.

9. An apparatus according to claim 8, wherein the loudspeaker comprises means for forming an essentially sinusoidal electrical variable-frequency calibration signal, in which case the calibration signal scans at least substantially through an entire audio frequency range.

10. The apparatus according to claim 8, wherein a scanning speed of the calibration signal is logarithmic.

11. The apparatus according to claim 9, wherein the scanning of the calibration signal is started from a low frequency range of human hearing.

12. The apparatus according to claim 8, wherein the apparatus is used to determine a distance from the loudspeaker and a measuring microphone.

13. The apparatus according to claim 8, wherein the apparatus is used to set the phase of a subwoofer and a main loudspeaker to be the same at a crossover frequency.

14. The apparatus according to claim 8, wherein the apparatus is used for calibrating the response of all the loudspeakers of the system, in a listening room.

15. The apparatus according to claim 8, wherein the loudspeaker contains an amplifier.

* * * * *